US006230877B1

(12) United States Patent
Sandberg et al.

(10) Patent No.: US 6,230,877 B1
(45) Date of Patent: May 15, 2001

(54) SAFETY PACKAGING

(75) Inventors: Thomas Sandberg; Anders Larsson; Tommy Bengtsson, all of Karlskoga (SE)

(73) Assignee: Team Safepac i Karlskoga AB, Karlskoga (SE)

( * ) Notice: Subject to any disclaimer, the term of this patent is extended or adjusted under 35 U.S.C. 154(b) by 0 days.

(21) Appl. No.: 09/423,632

(22) PCT Filed: Mar. 12, 1999

(86) PCT No.: PCT/SE99/00391

§ 371 Date: Jan. 19, 2000

§ 102(e) Date: Jan. 19, 2000

(87) PCT Pub. No.: WO99/47881

PCT Pub. Date: Sep. 23, 1999

(30) Foreign Application Priority Data

Mar. 17, 1998 (SE) ..... 9800916

(51) Int. Cl.[7] ..... F42B 39/00

(52) U.S. Cl. ..... 206/3; 206/523; 206/524.1; 220/560.01

(58) Field of Search ..... 206/3, 317, 521, 206/523, 524.1, 524.2, 524.4, 524.5; 220/88.1, 592.3, 560.01, 367.1; 102/293

(56) References Cited

U.S. PATENT DOCUMENTS

| | | | | |
|---|---|---|---|---|
| 3,432,666 | * | 3/1969 | Nash et al. | 206/524.1 |
| 3,484,015 | * | 12/1969 | Rowan | 220/367.1 |
| 4,529,638 | * | 7/1985 | Yamamoto et al. | 220/592.2 |
| 5,160,468 | * | 11/1992 | Halsey et al. | 206/3 |
| 5,285,559 | * | 2/1994 | Thompson et al. | 206/523 |
| 5,865,037 | * | 2/1999 | Bostic | 220/367.1 |

* cited by examiner

*Primary Examiner*—Luan K. Bui
(74) *Attorney, Agent, or Firm*—Dennison, Scheiner, Schultz & Wakemar

(57) ABSTRACT

A safety package is disclosed which includes a tubular member having first and second opposed end openings, a layer of heat insulative material inside the tubular member and a layer of heat insensitive material overlying the insulative material. Explosives or other volatile materials are placed in a depression in the heat insulative material and covered with the heat insensitive material to protect them from heat and fire to make transportation of such materials safer. In the event that the explosive materials are ignited, the gasses generated by the ensuing explosion will be vented in a non-unidirectional manner through the end openings and optional vent openings.

6 Claims, 1 Drawing Sheet

SAFETY PACKAGING

FIELD OF THE INVENTION

The present invention is directed toward safety packaging, and more specifically, toward packaging for safely holding and transporting explosives and other volatile materials.

BACKGROUND OF THE INVENTION

The growing use of explosives and explosive devices for civil applications is accompanied by a concomitant increase in the transport of such substances and devices. At the same time, the requirements for safer transport, (as well as more efficient methods for safely combating fires resulting from accidents), are becoming ever more severe and wide-ranging. It would therefore be desirable to provide improved packaging for explosives and other volatile substance that would protect such substances from excessive heating when exposed to fire or high heat and that would minimize damage to surrounding persons and property if such substances do ignite or explode.

SUMMARY OF THE INVENTION

Safety during transport can be considerably improved by using packaging which is so designed that the sequence of reactions which is to be expected in the event of accident can be controlled. In a preferred embodiment, packaging comprising a tube having first and second open ends is provided for housing an explosive or other volatile material. While the invention is useful with various materials that may burn or explode when subjected to high heat or flames, the volatile substance will be described herein as an explosive.

The tube of the preferred embodiment is used in a generally horizontal orientation with a first portion of its sidewall resting on a support surface and the first and second end openings of the tubular package facing in opposite directions. The portion of the tube near the support surface is generally referred to as the bottom while the opposite portion of the sidewall is referred to as the top. The package includes a layer of heat insulative material along the bottom portion. Explosives or other materials are received in a depression in the insulative material and a layer of heat insensitive material is placed over the explosive. Vent holes are also included in the top portion of the tube. Optionally, materials can be added to the layer of insulative material that absorb heat by phase transformation. This arrangement effectively shields the explosive materials from heat. In addition, if the explosive ignites after a long exposure to heat, the side and vent openings help insure that explosive gasses will be vented in a non-unidirectional matter.

DETAILED DESCRIPTION OF A PREFERRED EMBODIMENT

Figure 1:
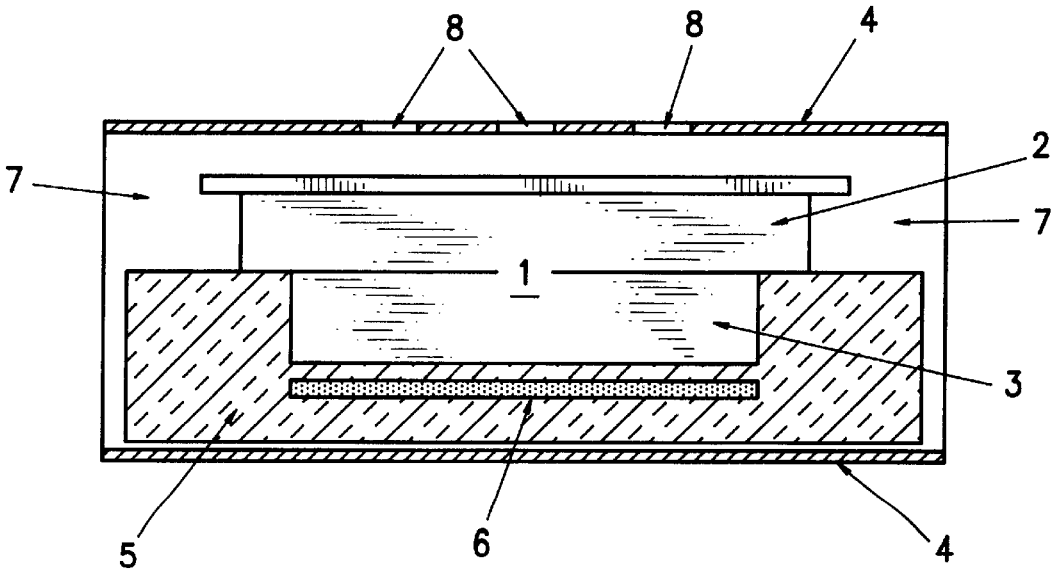
FIG. 1 is a side elevation view, partly in section, of the safety packaging of the subject invention with a block of explosive material contained therein.

An example of such design (the subject of the present patent application) is given in FIG. 1. Insulation (5) protects volatile, heat-sensitive components against too rapid external heating. The insulation is made from heat resistant material with low thermal conductivity, (e.g. rock wool). Depending on demands, thermal protection can be increased by adding complementary substances (6) to the insulation. Enclosed in special containers, or in various forms of microcapsules, these substances could absorb heat by phase transformation, (e.g. melting).

Through calculation and testing, the insulation can be dimensioned so that the time to the ignition of the heat sensitive component (3) is suited to the product's thermal characteristics, the external environment and the relevant safety requirements.

Along with the insulation (5), the product to be transported (1) is placed in a suitable protective container (4), e.g. a pipe. Product and insulation are so arranged that the heat insensitive component (2) is not protected against heating. In the event of fire, the heat sensitive component (2) will ignite or be destroyed by heat generated decomposition before the heat sensitive component (3) which is protected by the insulating bed.

The heat necessary for the decomposition of the heat insensitive component (2) is provided through the pipe end openings (7) and the air holes (8) in the protective container (4). As gasses are vented from the purpose designed and dimensioned protective container (4) after they have escaped via the openings (7), the heat insensitive component (2) cannot now explode randomly in a single direction and occasion unidirectional reaction forces.

FIG. 1

1. The product being carried
2. Insensitive component
3. Heat sensitive component
4. Protective container
5. Bed of thermal insulation
6. Container (or microcapsules) with heat absorbing substances
7. Openings
8. Air holes

What is claimed is:

1. A safety package comprising:

a tubular member including a sidewall having an inner wall portion and an outer wall portion and first and second end openings, said sidewall including a bottom portion adapted to support said safety packaging on a support surface and a top portion;

a layer of heat insulative material disposed in said tubular member along a first portion of said inner wall portion, said layer of heat insulative material including a depression for receiving a block of a material; and a layer of heat insensitive material removably mounted over said depression;

whereby said heat insulative material and said heat insensitive material protect said block of material from heat.

2. The safety package of claim 1 further including a secondary heat absorbing material disposed in a container in said layer of heat insulative material.

3. The safety package of claim 2 wherein said secondary heat absorbing material is microencapsulated.

4. The safety package of claim 3 wherein said heat insensitive material is decomposable through pyrolysis.

5. The safety package of claim 1 wherein said top portion includes vent openings.

6. A safety package comprising a tubular member having a longitudinal axis and first and second opposed end openings;

a layer of insulative material disposed along the length of said tubular member between said end openings;

a layer of heat insensitive material disposed on said layer of insulative material; and, a plurality of vent openings in said tubular member;

whereby, the gases generated by the ignition of an explosive material within said safety package are vented in a non-unidirectional manner.

* * * * *